US007513009B1

(12) United States Patent
Strawn

(10) Patent No.: US 7,513,009 B1
(45) Date of Patent: Apr. 7, 2009

(54) GLITTER VACUUM

(76) Inventor: Wanda Strawn, 25545 Fallenwood, Lake Forest, CA (US) 92630

( * ) Notice: Subject to any disclaimer, the term of this patent is extended or adjusted under 35 U.S.C. 154(b) by 664 days.

(21) Appl. No.: 11/137,669

(22) Filed: May 25, 2005

Related U.S. Application Data

(63) Continuation-in-part of application No. 10/634,411, filed on Aug. 4, 2003, now abandoned.

(60) Provisional application No. 60/402,101, filed on Aug. 8, 2002.

(51) Int. Cl.
*A47L 5/24* (2006.01)

(52) U.S. Cl. ..... 15/344

(58) Field of Classification Search ..... 15/344, 15/347, 352, 353
See application file for complete search history.

(56) References Cited

U.S. PATENT DOCUMENTS 2,205,599 A * 6/1940 Mitchell ..... 15/344
3,214,861 A * 11/1965 Arther ..... 43/139
3,759,766 A * 9/1973 Mangus ..... 216/42
4,605,499 A * 8/1986 Wise ..... 210/282
4,607,451 A * 8/1986 Jarecki ..... 43/139
5,052,147 A * 10/1991 Broomfield et al. ..... 43/139
5,084,937 A * 2/1992 Hague ..... 15/3.53
5,604,953 A * 2/1997 Castwall et al. ..... 15/323
5,664,282 A * 9/1997 Castwall et al. ..... 15/319
5,768,743 A * 6/1998 Webster ..... 15/330
6,314,609 B1 * 11/2001 George ..... 15/341
6,968,593 B1 * 11/2005 Lenkiewicz et al. ..... 15/320

* cited by examiner

*Primary Examiner*—David B Thomas
(74) *Attorney, Agent, or Firm*—Kenneth L Tolar

(57) ABSTRACT

A glitter vacuum for reclaiming otherwise wasted glitter particles includes a hollow housing having a motorized vacuum impeller therein. A vacuum nozzle is secured to an air intake port on a first end of the housing. A removable glitter receiving jar is secured to a glitter discharge opening on a lower surface of the housing. An angularly positioned deflector plate within the housing interior directs glitter from the vacuum nozzle into the glitter jar. The deflector plate is impermeable but for a plurality of peripherally disposed apertures that allow the passage of air while deflecting glitter and similar larger particles. A pair of filters are positioned between the deflector plate and impeller for trapping particulates that may inadvertently circumvent the plate.

12 Claims, 1 Drawing Sheet

GLITTER VACUUM

CROSS REFERENCE TO RELATED APPLICATIONS

This application is a continuation-in-part of U.S. patent application Ser. No. 10/634,411 filed on Aug. 4, 2003, now abandoned, which is entitled to the benefit of provisional application No. 60/402,101 filed on Aug. 8, 2002.

BACKGROUND OF THE INVENTION

The present invention relates to a glitter vacuum for reclaiming waste glitter.

DESCRIPTION OF THE PRIOR ART

Glitter is used as a decoration in a variety of craft work applications. However, due to the fineness of glitter particles, a significant amount thereof often fails to adhere to a target surface and is therefore scattered about a work area. The scattered glitter is not only unsightly but also results in significant glitter waste. Accordingly, there is currently a need for a device that allows those engaging in certain craft work to conveniently reclaim misapplied glitter. The present invention addresses this need by providing a uniquely designed vacuum that removes and stores scattered glitter for later use.

SUMMARY OF THE INVENTION

The present invention relates to a glitter vacuum for reclaiming otherwise wasted glitter particles including a hollow housing having a motorized vacuum impeller therein. A vacuum nozzle is secured to an air intake port on a first end of the housing. A removable glitter receiving jar is secured to a glitter discharge opening on a lower surface of the housing. An angularly positioned deflector plate within the housing interior directs glitter from the vacuum nozzle into the glitter jar. The deflector plate is impermeable but for a plurality of peripherally disposed apertures that allow the passage of air while deflecting glitter and similar larger particles. A pair of filters are positioned between the deflector plate and impeller for trapping particulates that may inadvertently circumvent the plate.

It is therefore an object of the present invention to provide a device that quickly and conveniently reclaims wasted glitter.

It is another object of the present invention to provide a glitter vacuum that eliminates the mess and inconvenience associated with performing certain craft work.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
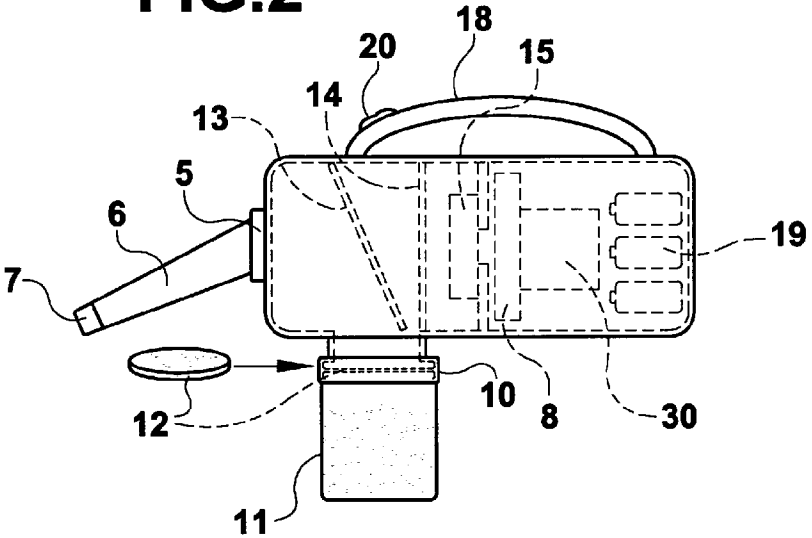
FIG. 2 is a side, cross-sectional view of the glitter vacuum according to the present invention.
Figure 4:
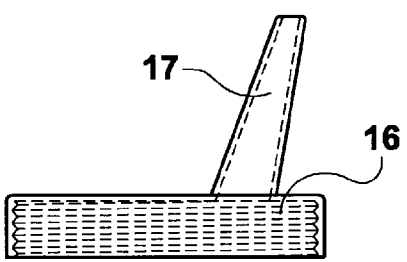
FIG. 4 depicts the glitter jar lid and spout.
Figure 1:
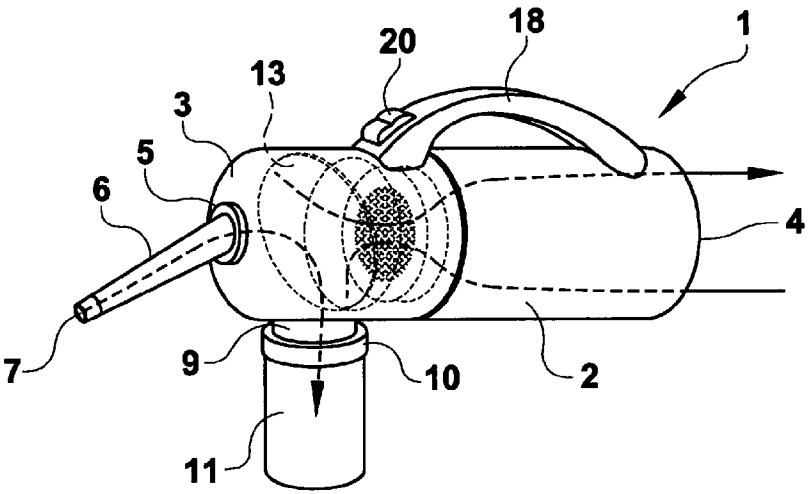
FIG. 1 is a perspective view of the glitter vacuum according to the present invention.
Figure 3:
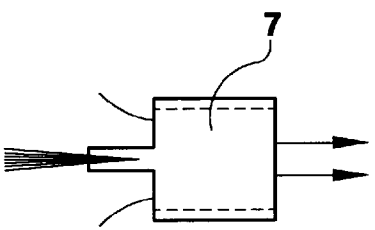
FIG. 3 is a side, cross-sectional view of the vacuum nozzle attachment.

The present invention relates to a glitter vacuum. The device comprises a housing 1 having a substantially hollow interior, at least one outer wall 2, a first end 3 and an opposing second end 4. Preferably, at least a portion of the housing is constructed with a translucent or transparent material allowing a user to observe the interior thereof. At the first end of the housing is an air intake port 5 having an elongated vacuum nozzle 6 obliquely depending therefrom. A brush attachment 7 may be secured to a distal end of the nozzle to assist in manipulating and removing glitter. On the opposing second end of the housing is an air outlet that is in fluid communication with the intake port. Received within the housing interior is a motor 30 driven impeller 8 that induces air flow from the nozzle to the air outlet.

On a lower portion of the housing outer wall is a glitter discharge opening 9 surrounded by an internally threaded sleeve 10 to which an externally threaded glitter jar 11 is removably secured. A glitter filter 12 is positioned at the interface of the jar and sleeve to prevent larger, undesirable particulates from entering the jar. The filter can also be designed to only allow passage of glitter particles having a predetermined size allowing smaller, unusable particles to be eliminated.

Received within the housing interior, proximal the air intake port, is an angularly extending deflector plate 13 positioned so as to deflect incoming glitter downwardly into the glitter discharge opening. The deflector plate is impermeable but for a plurality peripherally disposed, minute air passages so that the plate deflects glitter entering the vacuum nozzle downwardly into the glitter jar while allowing the passage of air to the air outlet. Positioned between the impeller and the deflector plate is a first stage filter 14 that entraps glitter and other particles that may inadvertently circumvent the deflector plate. Between the first stage filter and impeller is a second stage filter 15 for removing glitter and other particles that may circumvent both the deflector plate and the first stage filter.

The jar also includes an internally threaded lid 16 with a spout 17 extending upwardly therefrom that can be secured to the glitter jar in lieu of the sleeve when the jar is detached from the glitter discharge opening. The lid and spout assist a user in conveniently transferring the reclaimed glitter to a separate storage container for later use.

On an upper portion of the housing outer wall is a handle 18 allowing a user to easily grasp and maneuver the device as needed. The impeller motor is powered with a plurality of replaceable or rechargeable batteries 19 stored within the housing interior. Accordingly, a switch 20 is positioned on the handle that establishes selective communication between the motor and batteries.

The above described device is not limited to the exact details of construction and enumeration of parts provided herein. For example, the porosity and type of media used in the glitter filter, the first stage filter and the second stage filter can be varied. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A glitter vacuum comprising:

a hollow housing having a substantially hollow interior, at least one outer wall, a first end and an opposing second end;

an air intake port at the first end of the housing, said port having an elongated vacuum nozzle obliquely depending therefrom;

an air outlet on the opposing second end of the housing that is in fluid communication with the intake port;

a motorized impeller received within the housing interior that induces air flow from the nozzle to the air outlet;

a glitter jar removably attached to the housing and in communication with the nozzle, said glitter jar having a glitter filter to prevent larger particulates from entering the jar whereby the impeller induces air flow through the nozzle to divert entrapped glitter particles to the jar;

an angularly-extending deflector plate received within the housing interior, proximal the air intake port, said plate positioned to deflect incoming glitter into the glitter jar, said plate constructed with an air-impermeable material and having a plurality of peripherally-disposed, minute air passages so that the plate deflects particles while allowing passage of air.

2. The vacuum according to claim 1 further comprising a first stage filter positioned between the impeller and the deflector plate that entraps particles that inadvertently circumvent the deflector plate.

3. The vacuum according to claim 2 further comprising a second stage filter between the first stage filter and impeller for removing particles that circumvent both the deflector plate and the first stage filter.

4. The vacuum according to claim 1 further comprising a brush attachment securable to a distal end of the nozzle to assist in manipulating and removing glitter.

5. The vacuum according to claim 1 wherein said jar also includes a lid removably securable thereto, said lid having a spout extending upwardly therefrom for assisting a user in conveniently pouring glitter contained within said jar into a separate storage container for later use.

6. A glitter vacuum comprising:

a hollow housing having a substantially hollow interior, at least one outer wall, a first end and an opposing second end;

an air intake port at the first end of the housing, said port having an elongated vacuum nozzle obliquely depending therefrom;

an air outlet on the opposing second end of the housing that is in fluid communication with the intake port;

a motorized impeller received within the housing interior that induces air flow from the nozzle to the air outlet;

a glitter jar removably attached to the housing that is in communication with the nozzle, said jar having a lid removably securable thereto, said lid having a spout extending upwardly therefrom for assisting a user in conveniently pouring glitter contained within said jar into a separate storage container for later use.

7. The vacuum according to claim 6 further comprising an angularly extending deflector plate received within the housing interior, proximal the air intake port, that is positioned to deflect incoming glitter into the glitter jar.

8. The vacuum according to claim 7 wherein said glitter jar further comprises a glitter filter to prevent larger particulates from entering the jar.

9. The vacuum according to claim 8 wherein the deflector plate is constructed with an air-impermeable material and includes a plurality of peripherally disposed, minute air passages so that the plate deflects particles while allowing passage of air.

10. The vacuum according to claim 9 further comprising a first stage filter positioned between the impeller and the deflector plate that entraps particles that inadvertently circumvent the deflector plate.

11. The vacuum according to claim 10 further comprising a second stage filter between the first stage filter and impeller for removing particles that circumvent both the deflector plate and the first stage filter.

12. The vacuum according to claim 6 further comprising a brush attachment securable to a distal end of the nozzle to assist in manipulating and removing glitter.

* * * * *